US007465379B2

(12) United States Patent
Siljan

(10) Patent No.: US 7,465,379 B2
(45) Date of Patent: Dec. 16, 2008

(54) ELECTROLYSIS CELL AND STRUCTURAL ELEMENTS TO BE USED THEREIN

(75) Inventor: Ole-Jacob Siljan, Skien (NO)

(73) Assignees: Cronus Energy AS, Oslo (NO); Norsk Hydro ASA, Oslo (NO)

( * ) Notice: Subject to any disclaimer, the term of this patent is extended or adjusted under 35 U.S.C. 154(b) by 266 days.

(21) Appl. No.: 10/549,455

(22) PCT Filed: Mar. 12, 2004

(86) PCT No.: PCT/NO2004/000070

§ 371 (c)(1),
(2), (4) Date: May 5, 2006

(87) PCT Pub. No.: WO2004/083489

PCT Pub. Date: Sep. 30, 2004

(65) Prior Publication Data

US 2006/0237305 A1 Oct. 26, 2006

(30) Foreign Application Priority Data

Mar. 17, 2003 (NO) ..... 20031220

(51) Int. Cl.
*C25C 3/10* (2006.01)
*C25C 3/08* (2006.01)

(52) U.S. Cl. ..... 204/247.5; 204/247.4; 204/243.1

(58) Field of Classification Search ..... 204/243.1, 204/247.4, 247.5
See application file for complete search history.

(56) References Cited

U.S. PATENT DOCUMENTS

| | | | | |
|---|---|---|---|---|
| 4,222,841 | A | 9/1980 | Miller | |
| 4,674,728 | A | 6/1987 | Aune et al. | |
| 5,023,043 | A * | 6/1991 | Kotzlowski et al. | 376/150 |
| 5,057,001 | A * | 10/1991 | Eucker et al. | 425/315 |

FOREIGN PATENT DOCUMENTS

| | | |
|---|---|---|
| EP | 0 790 472 | 8/1997 |
| GB | 2076428 | 12/1981 |
| WO | 87/00211 | 1/1987 |
| WO | 01/94667 | 12/2001 |

* cited by examiner

*Primary Examiner*—Bruce F Bell
(74) *Attorney, Agent, or Firm*—Wenderoth, Lind & Ponack, L.L.P.

(57) ABSTRACT

An arrangement of one or more structural elements (3) in a cell lining, in particular for use as a side lining in aluminum electrolysis cells (5). The design of and choice of materials for side linings can be fitted in existing electrolysis cells, plus the design and production of the stated material is selected in view of the main purpose of the material, which is to utilize it for the purpose of energy recovery in electrolysis cells. Possible materials for use in the elements and production of these elements are disclosed.

18 Claims, 7 Drawing Sheets

7B

7A

ELECTROLYSIS CELL AND STRUCTURAL ELEMENTS TO BE USED THEREIN

BACKGROUND OF THE INVENTION

In the production of aluminium with current electrolysis technology, based on so-called Hall-Héroult cells, the operation of the cells depends on the formation and maintenance of a protective layer of frozen electrolyte in the side lining of the cell. This frozen bath is called the side layer, and it protects the cell's side lining against chemical and mechanical wear. It is an essential condition for achieving long cell lives. The crystallized bath also functions as a buffer for the cell with regard to changes in thermal balance. During operation, the generation of heat and the thermal balance in the cell will vary as a consequence of undesired operating disturbances (changes in bath acidity, changes in aluminium concentration, changes in interpolar distance, etc.) and desired events in the cells (tapping metal, changing anodes, anodic effect, etc.). This leads to the thickness of the layer changing in the periphery of the cell, and, in some cases, the layer may disappear entirely in parts of the periphery. The side lining will then be exposed to electrolyte and metal, which, in combination with oxidizing gases, will lead to corrosion of the side lining materials with the result that they will be eroded. Over long-term operation, leakages in the side are often the result of such repeated events. It is therefore important to control layer formation and layer stability in Hall-Héroult cells. For Hall-Héroult cells with a high current density, model calculations show that it will be difficult to maintain the side layer in the cell on account of high heat generation. For such cells and for traditional cells with thermal balance problems, long cell life will therefore be subject to the ability to maintain the layer that protects the side lining.

Production of aluminium in accordance with the Hall-Héroult principle currently takes place with relatively high energy consumption measured in kilowatt hours per kilogram of aluminium. Heat is generated in an electrolysis cell as a consequence of ohmic voltage drop in the cell, for example in current leads, produced metal and, not least, in the electrolyte. Around 55% of energy supplied to the electrolysis cell is used to produce heat in the cell. Literature data indicates that approximately 40% of the total heat loss from the cells is through the side lining. On account of the high heat loss and the protective, frozen layer in the side lining, this area of the cell is an advantageous place for elements for heat recovery.

In order to optimize both of these aims simultaneously, i.e. control of layer formation and heat recovery, it is important for the heat recovery to take place as close to the side layer formed as possible. This will result in the control of and speed of layer formation being as fast as possible and the temperature difference between incoming and outgoing coolant being as high as possible. The latter is optimal for energy utilization/recovery.

The present invention concerns an improved material design and production of this in order to contribute to increased control of side layer formation and the possibility of heat recovery in aluminium electrolysis cells.

The use of heat exchange to regulate heat flow in aluminium electrolysis cells has previously been described in German patent publications, among others. Publications DE 3033710 and EP 0047227 from Alusuisse both describe this technology. The publications describe a "construction" that is embedded in the cell's side lining. Heat is conducted through this construction and on to the outside of the cell where it is exchanged with a coolant, for example based on sodium metal. This coolant and the construction of the heat exchanger are known from previous publications and are usually called heat pipes. The material used in the cooling unit is made of metal with good heat-conducting properties. To increase the effectiveness of the heat exchange, an insulating layer is inserted between the carbonaceous side lining and the steel casing of the electrolysis cell. As indicated in the two publications, one of the aims of the design is to regulate heat flow through the cell's side lining and thus control the thickness of the side layer. In addition, they refer to the invention also making it possible to operate existing cells with increased current intensity, and increases of up to 25% are suggested.

U.S. Pat. No. 4,222,841 describes a possibility for heat exchange in aluminium electrolysis cells. The patent is based on the introduction of tubular cooling ducts in the side lining and base lining and over the electrolyte. The aim of the cooling is to control the bath temperature in the electrolysis cell and make cell operation, i.e. layer formation in the side lining, more independent of the current intensity supplied to the cell. The patent does not describe which materials are to be used in the heat exchanger, but it stipulates that they must be resistant to the corrosive atmosphere in the cell and also be oxidation-resistant as air is proposed as a coolant, among other things.

WO 83/01631 refers to a device for heat exchange of hot exhaust gases from closed electrolysis cells. The heat in the exhaust gases is used to preheat the feed flow of aluminium oxide to the electrolysis cell, and the regulation of the side layer's thickness in the cell as such is not an issue.

WO 87/00211 (see also NO 86/00048) from H-Invent describes a principle and a method for heat recovery from aluminium electrolysis cells. The publication describes metal plates with spiral ducts for extraction of heat from the side lining. Various coolants can be used. Among others, helium is mentioned in particular in the patent. The hot exhaust gases from heat exchange in the side lining can be used for energy production by driving an expansion machine that, in turn, drives an electric generator. The material in the heat exchanger plates is made of metal. In order to protect these plates against liquid electrolyte, an external layer of fireproof material, for example carbon, is used against the electrolyte. One problem with this solution will be ensuring good contact between the heat exchanger plates and the external cladding of fireproof material. Poor contact between these two layers will reduce the effect of the heat exchanger installation and thus lead to reduced heat recovery and reduced control of the side layer's thickness in the electrolysis cell.

Norwegian patent applications NO 20002889, NO 20014874 and NO 20005707, international patent application WO 02/39043 and Norwegian patent NO 312770, all from Elkem Aluminium, describe a different version of the previously mentioned heat pipes for cooling aluminium electrolysis cells, among others. The patents describe heat pipes for which sodium metal is mentioned in particular as a coolant. The side walls of the electrolysis cell are thermally insulated with a fireproof material between the steel shell and an inner evaporation-cooled panel that is in contact with the electrolyte and/or the frozen side layer. The lower part of the evaporation-cooled panel contains liquid coolant that evaporates on account of the heat supplied from the electrolyte, and the upper part of the evaporation-cooled panel contains a closed cooling duct connected to an outer circuit. In this part of the evaporation-cooled panel, the coolant will condense, and heat can be extracted through the coolant, preferably various types of gas that flow through the cooling duct mentioned above. In the case of heat exchange in several stages, the heat emitted from the electrolysis cell can be used to drive an electric turbine to generate electricity. This will result in a considerable reduction in the effective electrical energy consumption in the electrolysis cell per tonne of aluminium produced. The patent (NO 312770) states that the evaporation-cooled panels should preferably be made of non-magnetic steel. A possible problem of this patent is associated with the difficulties of producing a corrosion-resistant steel that will function in an atmosphere consisting of oxygen and fluorides at around 1000° C. It is known from the literature that the presence of fluorides at elevated temperatures produces a dramatic increase in the oxidation rate of steel.

SUMMARY OF THE INVENTION

The present invention relates to an arrangement of one or more structural elements for the design of a side lining material for cooling side linings in aluminium electrolysis cells with the intention of controlling and adjusting the side layer thickness in the cells. With the chosen design of the side lining materials, it is also possible to carry out heat exchange in such cells with the possibility of recovering heat as electrical energy and/or low-temperature heat. The design of the side lining materials in the present solution means the design, creation and production of ducts in the material with the intention of conducting coolant through the material in order to cool the side lining and/or exchange heat from the electrolysis cell. The invention also comprises materials suitable for use in aluminium electrolysis cells and production of these materials with the ducts mentioned above.

The present invention is based on cooling of the side lining for layer control and heat exchange taking place inside the actual side lining materials rather than on the outside of the cell case or between the cell case and the side lining material in the cell. This requires the cell lining materials to be fitted with cavities/ducts for the introduction and extraction of coolant.

BRIEF DESCRIPTION OF THE DRAWINGS

The above-described advantages and additional advantages can be achieved with the invention in accordance with the attached claims. The present invention will be described in further detail in the following using examples and figures, where:

DETAILED DESCRIPTION OF THE INVENTION

Figure 1:
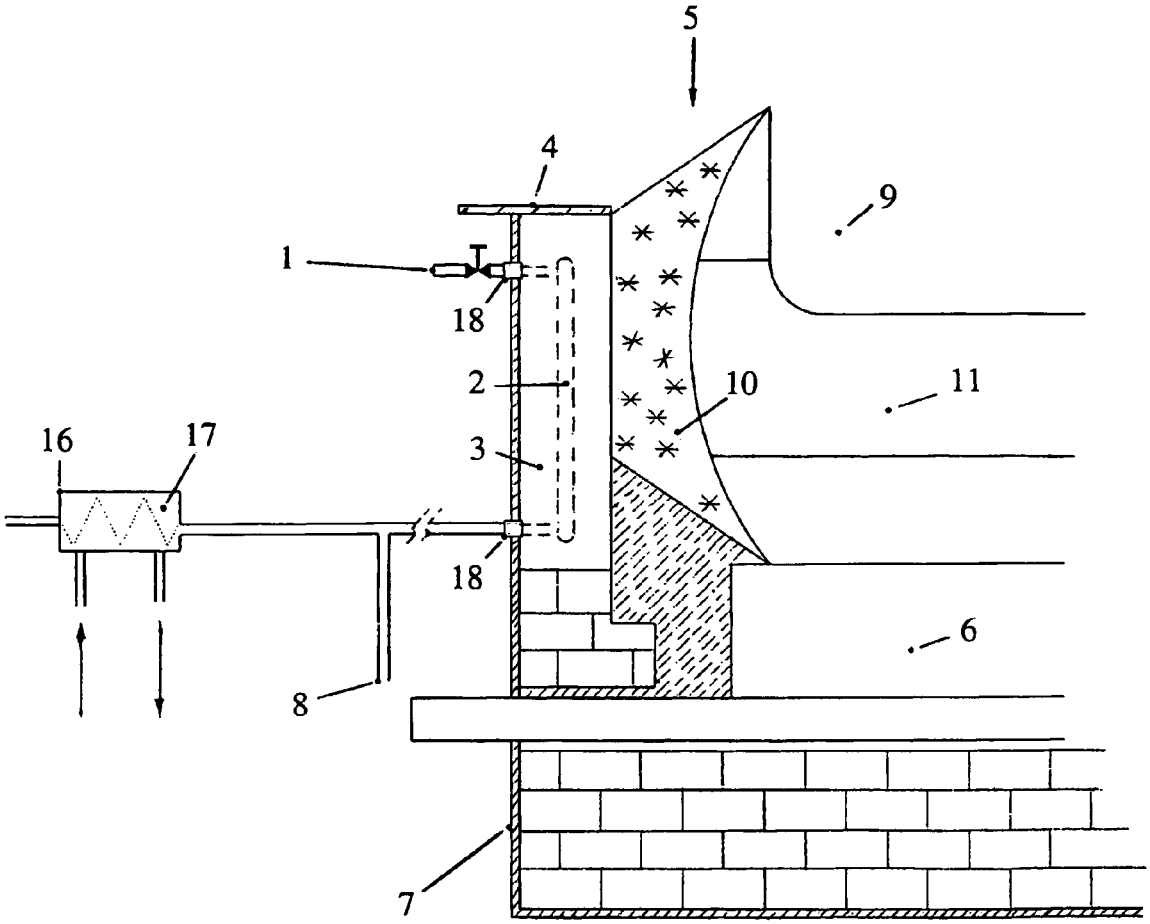
FIG. 1 shows a first design of a side lining plate with ducts for the through-flow of coolant and connection points for the supply and extraction of coolant located in relation to other lining elements in an aluminium electrolysis cell.

As illustrated in FIG. 1, the principle of the present invention is that it is possible to cool the side lining in an aluminium electrolysis cell by ensuring the through-flow of a coolant 1 in ducts 2 or in plates 3 used as the side lining material in aluminium electrolysis cells. The extent of the plates is determined by the need for cooling in the electrolysis cells, but will usually be from the cover plate 4 on the electrolysis cell 5 to level with the surface of the cathode carbons 6. The coolant 1 is supplied from outside the cathode case 7 and is also extracted from the plates 3 from outside the cathode case 7. Several plates 3 may also be connected together to create a longer continuous cooling loop.

Figure 2:
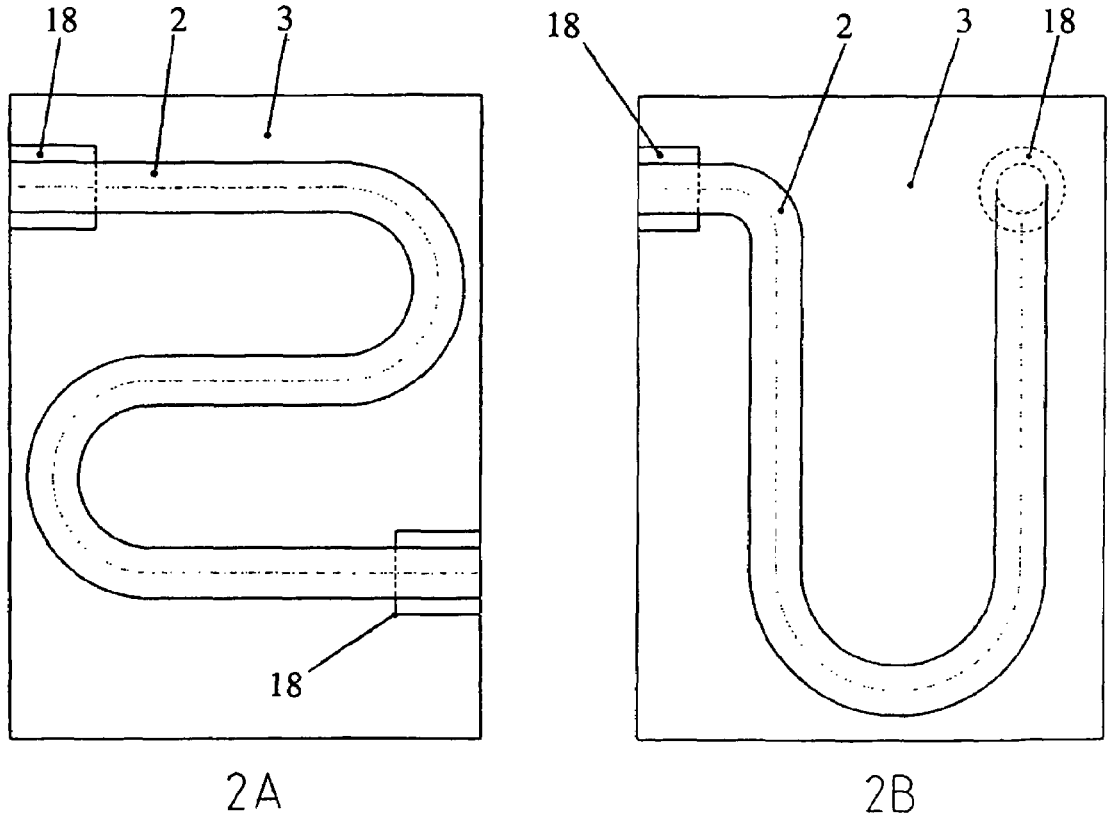
FIGS. 2A-2B show some possible designs of ducts in side lining plates for the through-flow of coolant.

In a traditional aluminium electrolysis cell 5 with carbon-based anodes 9, around 40% of the cell's total heat loss will be through the side lining. The electrolysis cell also depends on being operated with a layer 10 of frozen electrolyte 111 at the side. In addition to protecting the side lining plates 3, this layer will also function as self-regulation for the cell in the event of varying heat generation in the cell. Heat will be produced (mainly) in the electrolyte and transported out through the side lining of the cell. It is therefore possible to regulate the heat flow out of the cell by supplying a coolant 1 in ducts 2 in the side lining plates 3 of the cell. The degree of the cooling effect will depend on the physical properties of the coolant (density, thermal capacity, etc.), the quantity of coolant flowing through, the surface area of the ducts and the design of the ducts (length) as shown in FIG. 2.

Figure 3:
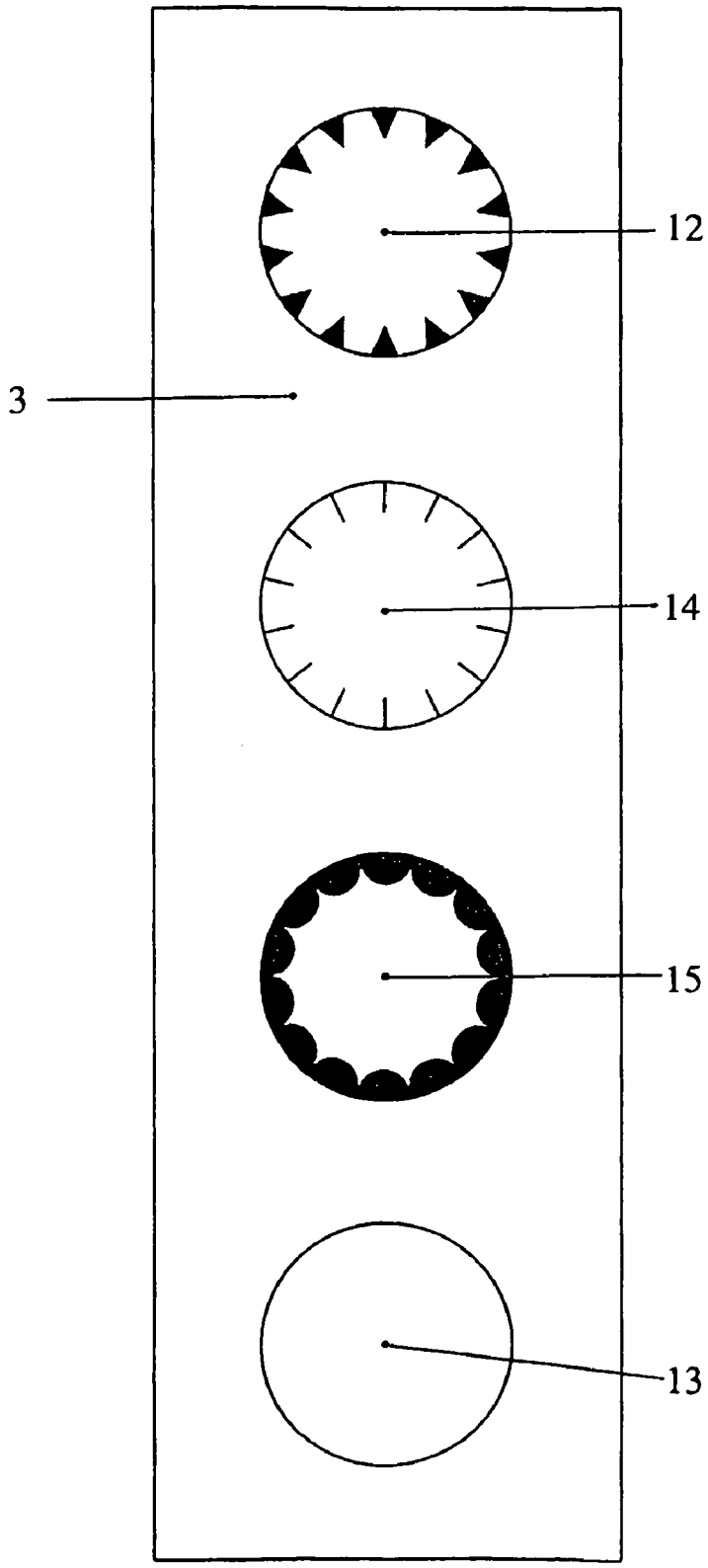
FIG. 3 shows sketches of different possibilities for varying the design of ducts in side lining plates to control the temperature of the outflowing coolant.

FIG. 3 shows various possible designs of the surface 12, 13, 14, 15 of ducts in side lining plates for aluminium electrolysis cells. It is known from the literature that increasing the surface area of the area of contact between the coolant and the hot surface will improve the heat transfer and produce a more effective heat exchanger. The most effective design of the ducts 2 would therefore be small, thin ducts with a small diameter. However, this is difficult to achieve with the materials on which the present invention is based because thin ducts would have a tendency to become sealed during the sintering of such ceramics. FIG. 3 therefore shows various measures for increasing the surface area of ducts based on smooth surfaces 13 in a generally circular geometry. These measures comprise making star-shaped surfaces 12, spiked surfaces 14 and sinusoidal (arched) surfaces 15.

The effectiveness of cooling the side lining plates 3 in aluminium electrolysis cells will, as stated above, depend, among other things, on the quantity of coolant flowing through and the surface area of the ducts. Heat transfer from the high-temperature reservoir, i.e. the side lining plates 3, to the coolant 1 will be fastest with the highest temperature difference, i.e. at the inlet of the cooling loop 2. After a period of time in the plate's ducts 2, the temperature of the coolant will approach the temperature of the heat reservoir, and the heat transfer from the reservoir to the coolant will decrease in speed. There is therefore an optimal length for the cooling loops, depending on the surface area, coolant and temperature difference. FIG. 2 shows several different possible designs of cooling loops 2 in order to achieve different degrees of cooling effectiveness. If the present invention is used in connection with heat exchange 16, it is important for the cooling loops to be made so that the temperature of the coolant entering the heat exchanger 17 is as high as possible in order to produce the highest possible heat exchange effectiveness (see FIG. 1). Gases and liquids may be used as the coolant. Heat transfer between the side lining material and liquids is generally much better than between the side lining material and gases. However, heat transfer also depends on the contact area and when gases are used, the contact area must be maximized in order to improve heat transfer, i.e. to increase the temperature of the outgoing gas flow.

Figure 4:
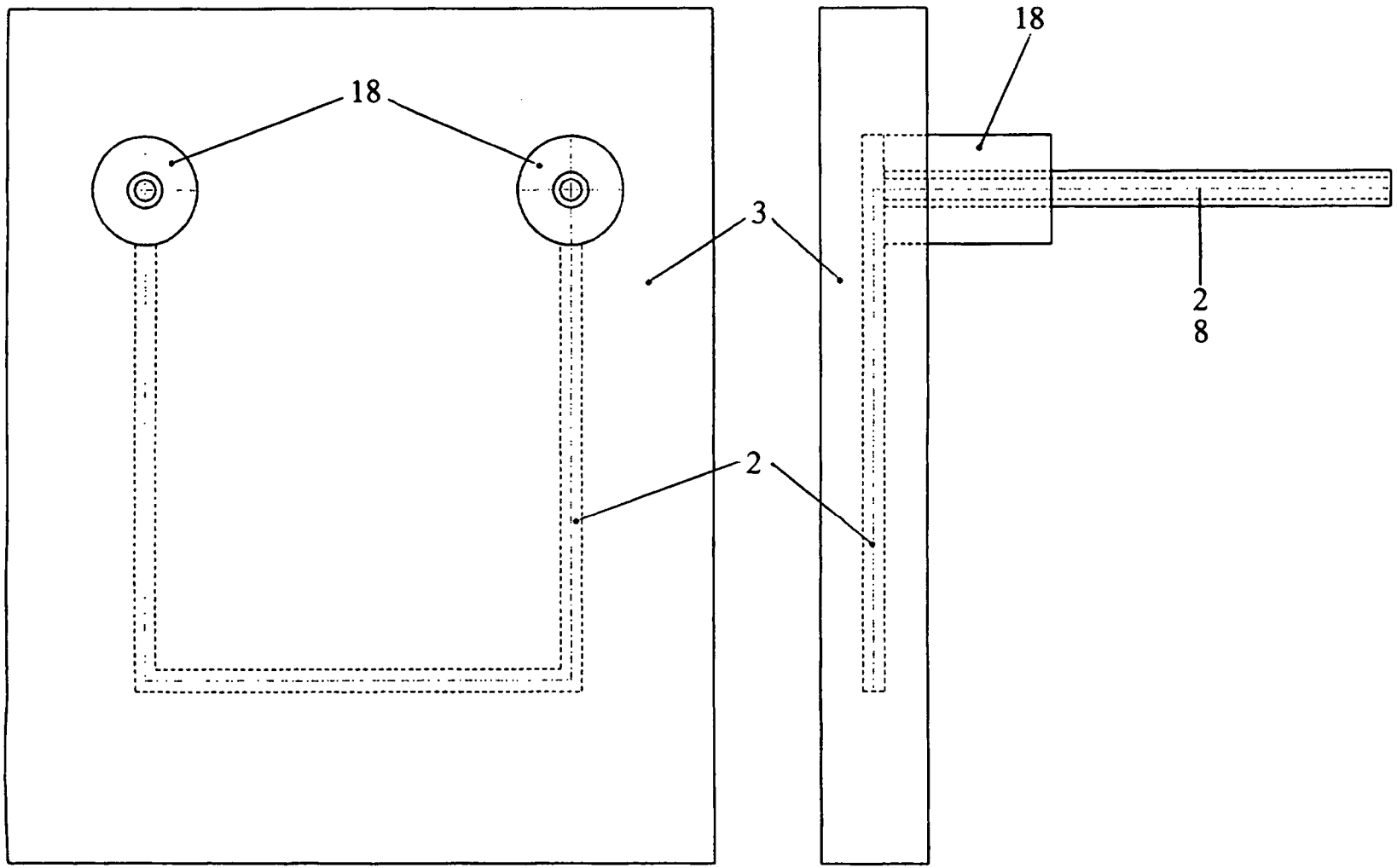
FIG. 4 shows a sketch of a side lining plate produced in the material silicon nitride-bound silicon carbide. The plate is molded by slip casting and subsequent nitriding.

Materials used in aluminium electrolysis cells are exposed to a very corrosive environment, including air at approximately 900-1000° C. and liquid cryolite-based melt at the same temperatures. Strict requirements are made of the materials' chemical resistance, and it is a precondition for the present patent that the materials must be able to resist these conditions without being damaged. Damage to the materials could result in fracture of the cooling loops and loss of control of cooling of the side lining, resulting in loss of control of the side layer's 10 thickness and extent. In addition to this requirement, the materials to be used in the present invention must also be produced in such a way that the stated ducts 2 can be created in the material in such a way that the ducts and/or the entire side lining plate 3 are gastight. On account of the complicated design of the ducts, it is regarded as very difficult to make them after the side lining plates 3 have been completed. The ducts 2 must therefore be created at an early stage in production, preferably before the materials are fired (sintered). Materials that are suitable for production of the present invention are therefore ceramic materials based on oxides, borides, carbides and nitrides and/or combinations of these materials. For all practical purposes, this will mean that the preferred materials for the side lining plates are materials like silicon carbide, silicon nitride, silicon oxynitride, aluminium nitride or combinations of these materials. However, the present invention is not limited to these materials. FIG. 4 shows a side lining plate 3 produced from silicon nitride-bound silicon carbide.

Figure 5:
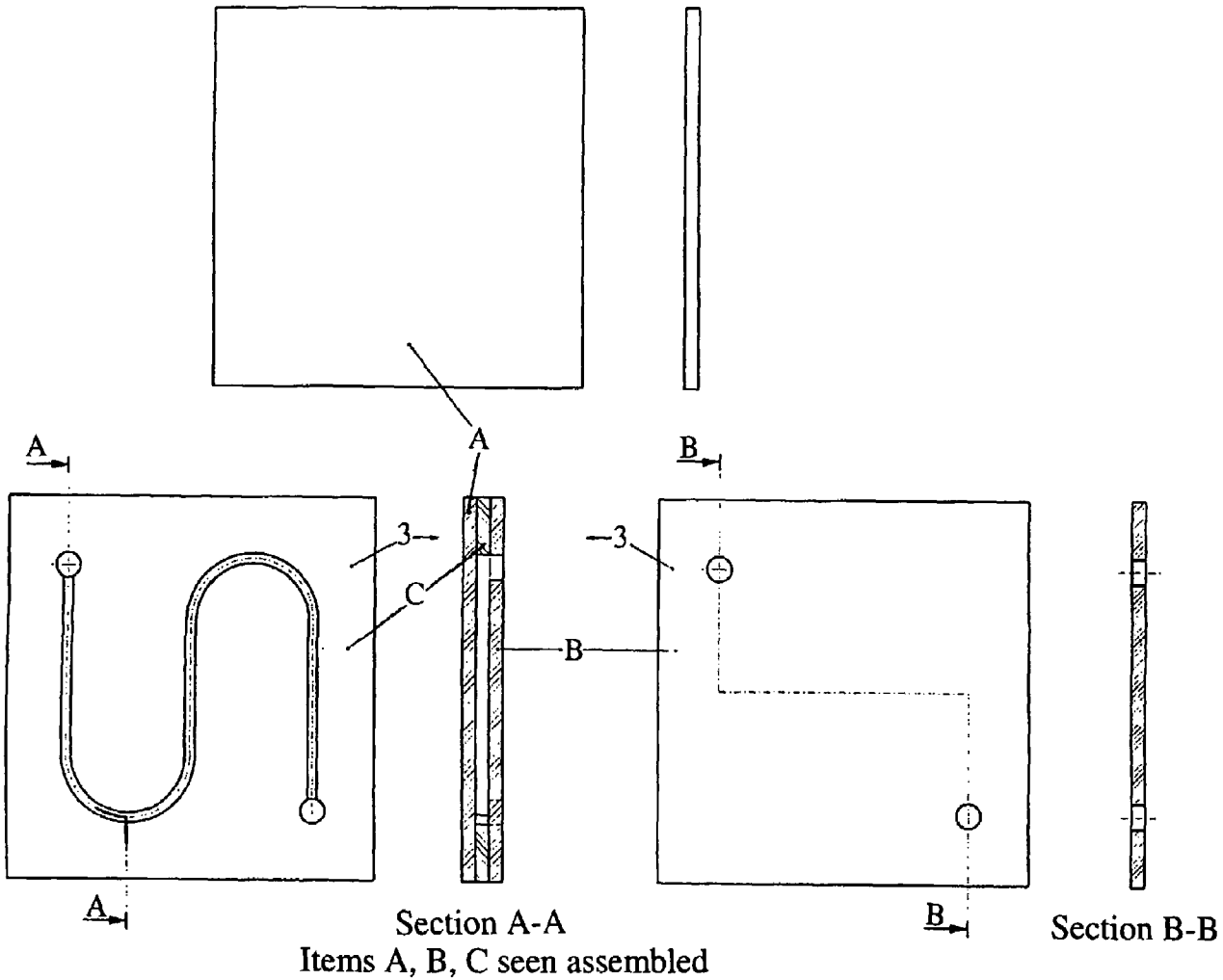
FIG. 5 shows another possible design of the side lining plate with ducts for the through-flow of coolant. Production is in accordance with the laminar method.
Figure 6:
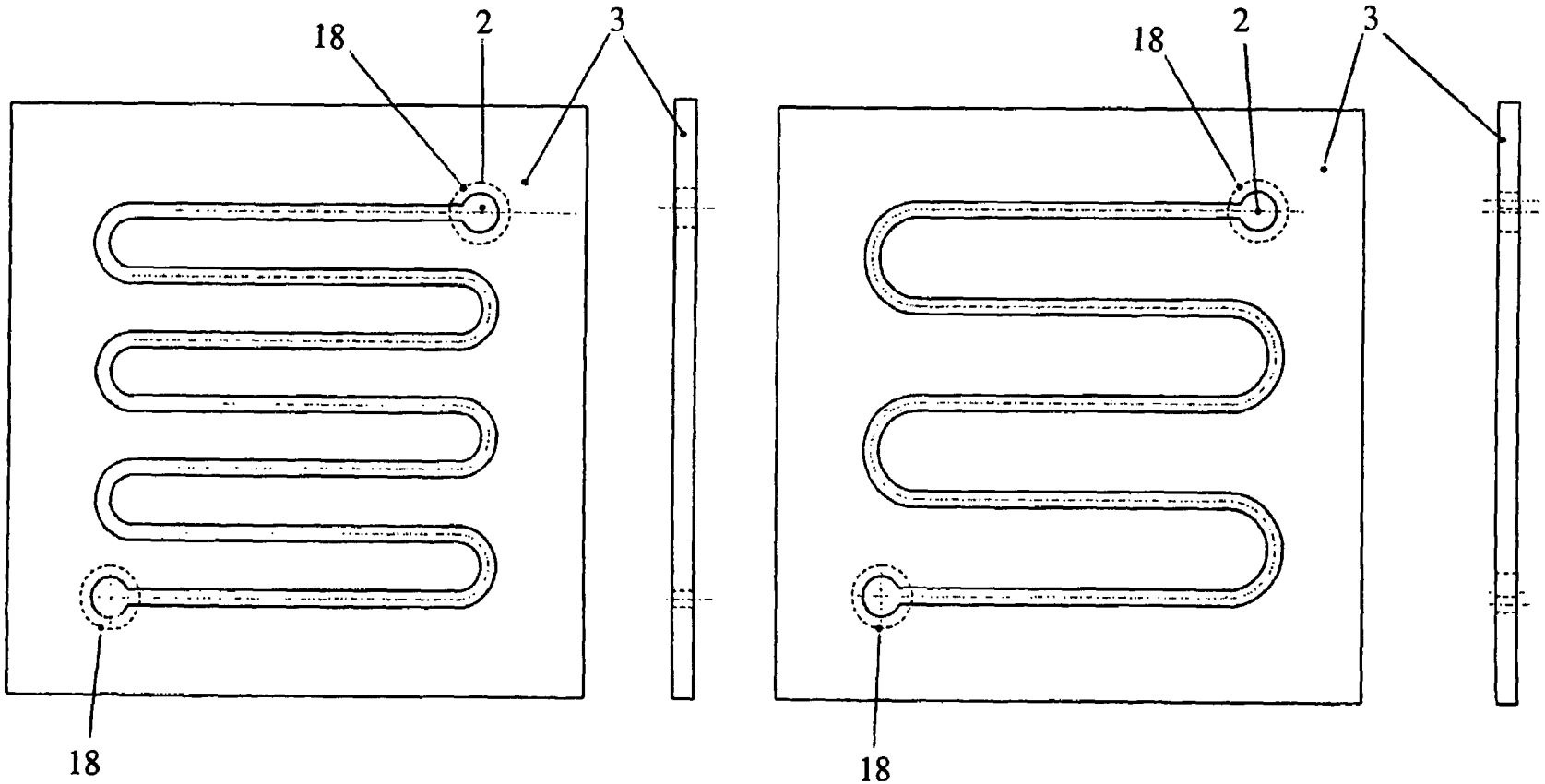
FIG. 6 shows a sketch of a combination of different units for the production of a heat-exchanging side lining plate. Production is in accordance with the laminar method.

Previous publications mentioned and described under "Prior Art" are based on a cooling construction being inserted in a side lining. The present patent makes use of the fact that materials can be made so that ducts 2 for the through-flow of coolant 1 can be made directly in the side lining plates 3. The production of ducts in ceramic materials belongs to the prior art, and a number of different techniques can be used to carry this out. In the present invention, some selected methods for the production of ducts 2 in side lining materials are described. However, the claims are not limited to these methods. FIGS. 4, 5 and 6 show an alternative method for the production of such side lining plates with ducts for the through-flow of coolant, characterized by production in accordance with the so-called laminar method.

The side lining elements described in the present invention can, in principle, be produced in two ways:

i) So that each individual side lining block functions as one independent heat exchanger unit.

ii) So that several side lining blocks function as one independent heat exchanger unit, the size of which can vary from under one square meter to the entire side of the cell.

Figure 7:
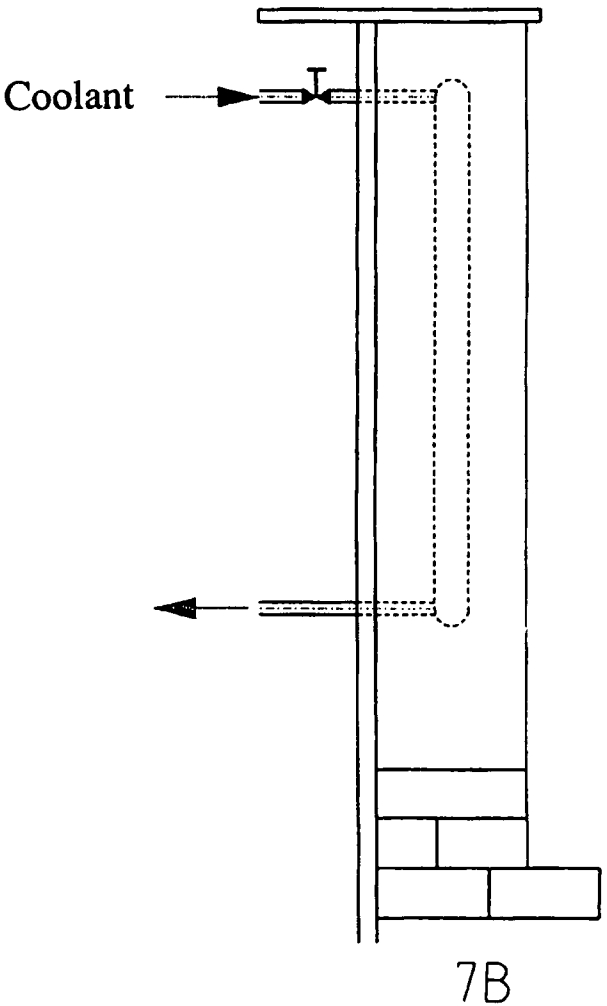
FIGS. 7A-7B show the design of cooling ducts to achieve either the best possible control of layer formation (FIG. 7*a*) or the maximum possible heat transfer to the coolant (FIG. 7*b*) in the cell.
Figure 7:
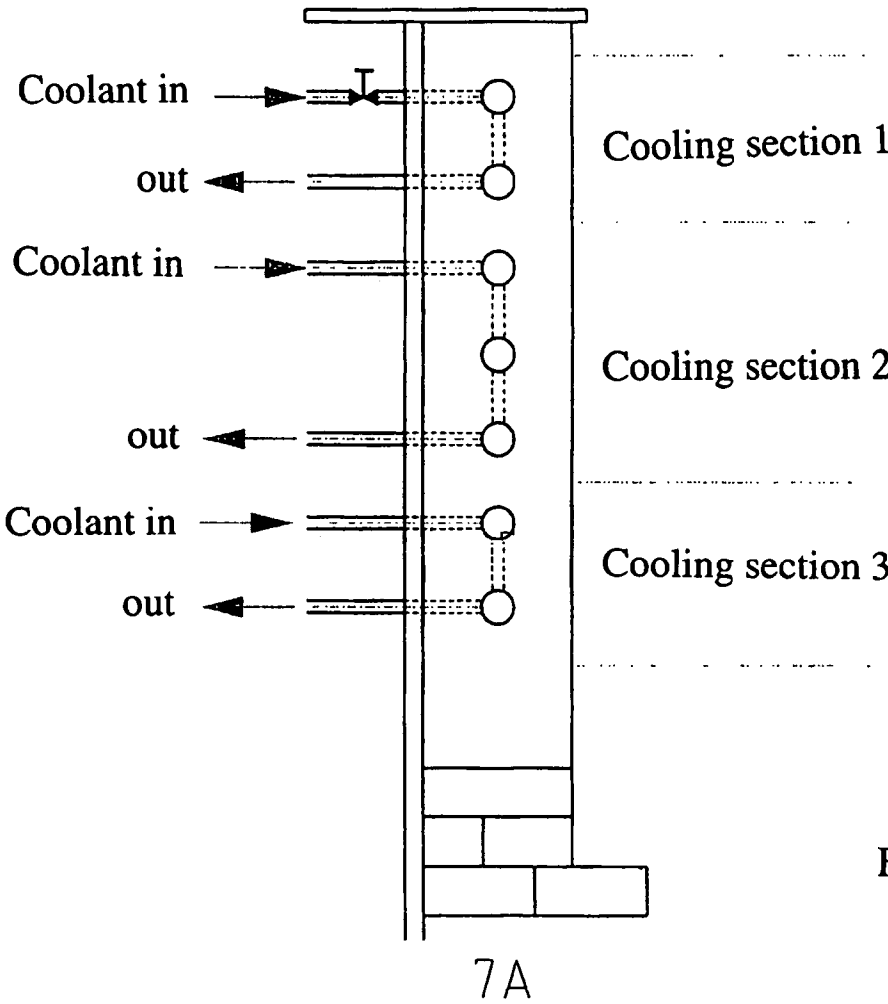

Two factors must be taken into consideration when designing the actual materials and their cavities/ducts: the desire for the maximum possible heat transfer to the coolant and the desire to control the layer formation/stability in the cell. In order to achieve the latter, the optimal method is to place the "cooling loops" horizontally in one or more zones along the side of the case. With the correct choice of process control equipment, the layer formation in, for example, the bath/metal transition can then be controlled separately from the layer formation in the lower part and upper part of the side lining. Another option, which primarily produces an optimal temperature in the outgoing gas, is to place the "cooling loops" vertically in one or more zones. Both these options are shown in FIGS. 7A-7B.

Standard ceramic production methods such as wet and dry pressing, plastic molding, extrusion, slip casting, etc. can be used to make the plates/elements in the present invention. If the elements are produced by pressing, stamping, etc., it is possible, for example, to make two half elements of the relevant material or a precursor of the final material. The half plates have a flat side that faces the electrolysis chamber and a flat side that faces the side of the case. The inner surface in the half blocks has recesses in the form of semicircles, ovals, spiked semicircles, etc. The recesses in the molds, which, in the finished material, will be ducts/cavities for conducting the coolant, can expediently be made with saw teeth, rifles or profiles to increase the total surface of the ducts in order to achieve better heat transfer to the coolant as shown in FIG. 3. After the two halves have been completed, i.e. stamped, pressed, cast, etc., they are glued together. The adhesive used may be one or more metals, materials of the same composition as the material produced, precursors of the material produced, combinations of these possible materials or other suitable chemical adhesives. The plates are glued together by the "glue" being applied to one or both of the two half plates on the side with the recesses. The glue is applied in the form of a suspension, slurry, dry powder (fine particles) or paste. In some cases, this glue may also be used to seal pores in the material and thus contribute to making it gastight, for example by dipping, spraying or smearing the surface of the plate, after it has been glued together, with the afore-mentioned glue. The final side lining element is then finished using standard ceramic production technology such as sintering to achieve mechanical strength. Sintering may take place in a controlled atmosphere to achieve the desired material properties. The elements may also be made by a burnout material with the shape of the desired duct being inserted in the press mould during filling. Such a burnout material may be based on plastic, rubber, wax, etc. or combinations of these materials. Other standardized methods for making ducts/cavities in ceramic materials are also possible.

The side lining material in the present patent is based on a number of materials, some of which are already in use in current cells. It goes without saying that some materials are better than others as a consequence of both chemical conditions and material costs. Both carbon-based materials and ceramic materials within the group of oxides, borides, carbides and nitrides, primarily based on aluminium, silicon, titanium, zirconium or combinations and composites of these materials, may be used in accordance with the present invention. The preferred choice of material is silicon nitride-bound silicon carbide ($Si_3N_4$/SiC), pure silicon carbide (SiSiC) or pure silicon nitride. SiAlON materials are also possible candidates for this purpose.

To extract heat from the aluminium electrolysis cell, it is necessary to use a suitable type of coolant for through-flow in the ducts 2 in the side lining plates 3. Suitable coolants in this connection are gases or liquids. Suitable gases include air, nitrogen, argon, helium, carbon dioxide, etc. However, the present invention is not limited to the use of these gases. Suitable liquids should have a high boiling point (>300° C.) at atmospheric pressure. In addition, liquid phases must be chemically inert in relation to the material chosen for the side lining plates so that the plates do not corrode during operation. Possible liquid coolants include in particular fused salts, oils, etc. However, the present invention is not limited to the use of these liquids. Water/steam may also be used.

The heat (energy) extracted from the aluminium electrolysis cell using the present invention may be used in several ways. One obvious possibility is to use the heat to preheat the feed to the electrolysis cell, i.e. counterflow preheating of aluminium oxide. This may, for example, be done by heat extracted from the ducts 2 in the side plates being used to preheat the aluminium oxide feed in a counterflow plate-type heat exchanger. However, there are also other ways of heat-exchanging feeds of alumina, although they will not be mentioned specifically here. Another obvious method for utilizing extracted energy is to use the heat to run an electric generator, for example a sterling motor or an expansion motor, as also mentioned in Norwegian patent application number NO 86/00048.

When using a coolant in connection with controlling the side layer and as a heat exchanger, it is important that no leakages occur in the cooling loop such as at the connection between the outer cooling loop 8 and the ducts 2 in the side lining elements 3. This is important regardless of whether each element 3 is connected directly to the outer cooling loop 8 or several side lining elements 3 are to be connected together to form a larger heat exchanger/cooling unit 16 with the coolant being conducted from block to block. This may, for example, be done by transitions 18 being made that are embedded in the individual facing blocks for leakage-free transfer of the coolant. The transitions are sealed with glue of the same type as mentioned above, refractory cements and/or suitable chemical adhesives. An example of such transitions is shown in example 4 below. Sleeves or transitions 18 between side lining plates and between side lining plates and the outer cooling loop may be based on ceramic and/or metallic materials. Considering the presence of corrosive gases in the side lining at high temperatures, the preferred material is based on ceramics such as alumina, aluminium silicates, silicon carbide, silicon nitride and/or combinations of these materials. However, the present invention is not limited to such materials for this purpose. In order to ensure gastight/leakproof transfer of coolant between elements and/or between elements and the outer cooling loop, the transitions 18 are fixed with a "glue". This "glue" may be based on ceramic materials (for example, refractory cement, refractory mortars, etc.), glass sealant and/or metallic sealants. However, the present invention is not limited to such materials for this purpose.

The present invention to control layer formation and/or for heat recovery in aluminium electrolysis cells can be used in cells of Hall-Héroult design with carbon-based anodes and cells with inert anodes. In addition, the present invention may also be used in aluminium electrolysis cells of a non-conventional design, for example cells described in the applicant's own patent application WO 02/066709 A1.

EXAMPLE 1

Plates made from a slurry of silicon metal and SiC particles were made by slip casting with a predetermined thickness of 8 mm. After the slip-cast plates were dried, a cutting tool based on high-pressure water was used to make holes and grooves/recesses of various lengths in some of the plates. Subsequently, sets of three plates were glued together with new slip as glue in such a way that the front plate had holes for the supply/extraction of coolant, the central plate had ducts for coolant and the rear plate was a sealed plate. The composite structure then constituted a heat exchanger unit, and this was placed in a nitriding furnace to sinter the construction into a gastight heat exchanger unit. FIG. 5 shows the design and composition of the plates of the heat exchanger unit, while FIG. 6 shows other designs of the ducts 2 with different duct lengths. The variation in the length of the ducts 2 means that the energy quantity extracted by the coolant 1 from the side lining plates 3 can be varied.

EXAMPLE 2

A plaster mold was made and, after the mold was put together, a PET hose filled with stearin wax was inserted in it to indicate the cavity in the plate for the coolant. A slip of SiC and silicon metal was put in the mold, and the unit was then dried before nitriding at around 1400° C. The cavity created by the burnout of the PET hose and stearin had a volume of around 31 $cm^3$ and the estimated surface area in the duct was approximately 122 $cm^2$. The finished construction was tested for leakages, and a pipe for the supply and extraction of coolant was adapted and fitted. These connections 18 to the surrounding cooling system 8, 16, 17 are described in further detail later in the application. The sketch in FIG. 4 shows a finished heat exchanger unit based on slip casting of a complete side lining plate with burnout materials for the creation of ducts 2.

EXAMPLE 3

A heat exchanger plate of silicon nitride-bound SiC produced as described in example 2 was fitted in the door opening of a standard batch furnace of type Nabertherm. The plate was insulated on the sides and rear by means of minimum 30 mm thick plates of the insulation material Keranap 50. Thermocouples to measure the temperature were fitted on the front of the heat exchanger plate, on the rear of the heat exchanger plate and in the outlet of the exhaust gas pipe for the coolant. The area of the plate that was in contact with the furnace chamber was 460 $cm^2$. The furnace was heated to different, predetermined temperatures and subsequently the through-flow of air as the coolant supplied to the plate through the inlet pipe was checked. Table 1 below shows the temperatures and gas quantities measured and the calculated heat extracted from the tests. The tests show that, in some cases, it is possible to extract considerable quantities of energy using a solution as outlined in the present patent. For a modern prebake electrolysis cell with a side lining area of 10-12 $m^2$, the tests show that quantities of energy equivalent to 1-25 kW can be removed with the specified length and diameter of the duct 2 and the size of the side lining plate 3.

TABLE 1

Results of measurements of temperatures and gas quantities, plus calculations of heat loss during the tests.

| Gas Quantity (l/min) | Gas Temp. in (° C.) | Gas Temp. out (° C.) | Temp. Difference (° C.) | Extracted Heat (W) | kW/m2 per unit pipe area | kW/m2 per unit surface area |
|---|---|---|---|---|---|---|
| 0.956 | 25.00 | 772.00 | 747.00 | 1.54 | 0.13 | 0.03 |
| 2.247 | 25.00 | 799.00 | 774.00 | 3.75 | 0.31 | 0.08 |
| 6.120 | 25.00 | 829.00 | 804.00 | 10.61 | 0.87 | 0.23 |

TABLE 1-continued

| Gas Quantity (l/min) | Gas Temp. in (° C.) | Gas Temp. out (° C.) | Temp. Difference (° C.) | Extracted Heat (W) | kW/m2 per unit pipe area | kW/m2 per unit surface area |
|---|---|---|---|---|---|---|
| | | Results of measurements of temperatures and gas quantities, plus calculations of heat loss during the tests. | | | | |
| 17.721 | 25.00 | 818.00 | 793.00 | 30.30 | 2.48 | 0.66 |
| 76.667 | 25.00 | 636.75 | 611.75 | 101.14 | 8.29 | 2.20 |

EXAMPLE 4

A heat exchanger plate of silicon nitride-bound SiC produced as described in example 2 was connected to an outer cooling loop in which air at room temperature was supplied through an inlet boss and hot air was let out through an outlet boss. The SiC element was produced with two "cups" for attaching the inlet and outlet bosses. Ceramic pipes were placed in the "cups", cast in place with a fireproof cement of type Cerastil and subsequently hardened at 120-130° C. for 16 hours. The unit was tested for leakages, and the tests showed that the attachment method chosen for the inlet and outlet bosses was sufficiently leakproof. Air as a coolant was subsequently supplied to the SiC element without leakages of cooling air.

The invention claimed is:

1. An arrangement of at least one structural element for use in an electrolysis cell for production of aluminum metal from a component containing aluminum in a fused salt, where the component containing aluminum is mainly alumina and the fused salt is mainly based on mixtures of NaF and $AlF_3$ and $CaF_2$, possibly plus alkali and alkaline earth halides, wherein the structural element is arranged in the electrolysis cell lining, and the structural element is plate shaped and made out of a material resistant to a corrosive environment in the cell, and further having a system of ducts formed directly in it and thereby constituting an integral part of the structural element, said ducts being arranged for the through-flow of a medium and further designed so that they can be used for active control of the side layer's thickness and heat transfer through the cell lining, and said ducts are connected to an outer circuit.

2. An arrangement in accordance with claim 1, wherein the ducts are designed with a mainly circular cross-section with a smooth, star-shaped, spiked or sinusoidal surface.

3. An arrangement in accordance with claim 1, wherein each of the structural elements is made of ceramics based on carbon, carbides, nitrides, borides or oxides or mixtures of these materials.

4. An arrangement in accordance with claim 1, wherein each of the structural elements is made of carbon, silicon nitride, aluminum nitride, silicon carbide, silicon oxynitride, silicon aluminum oxynitride, titanium diboride, zirconium diboride or mixtures of these materials.

5. An arrangement in accordance with claim 1, wherein each of the structural elements is made by dry or wet pressing, slip casting and/or stamping and the ducts are made by means of grooves in plates that are subsequently glued together before sintering.

6. An arrangement in accordance with claim 5, wherein each of the structural elements is made using glue based on refractory cements, silicon metal, etc. to join the parts before sintering and to contribute to the elements being gastight after sintering.

7. An arrangement in accordance with claim 1, wherein each of the structural elements is made using the so-called lost wax method, burnout material and/or cutting out plates for subsequent assembly in accordance with the laminar method.

8. An arrangement in accordance with claim 1, wherein each of the structural elements is made using production methods that ensure gastight elements made by optimizing the green body and/or glazing/impregnation of the finished material.

9. An arrangement in accordance with claim 1, wherein each of the structural elements is provided with sleeves and/or transitions for connection to an outer circuit.

10. An electrolysis cell for production of aluminum metal from a component containing aluminum in a fused salt, where the component containing aluminum is mainly alumina and the fused salt is mainly based on mixtures of NaF and $AlF_3$ and $CaF_2$, possibly plus alkali and alkaline earth halides, the electrolysis cell comprising:

a cathode case;

a side lining disposed inside of the cathode case, the side lining including at least one side lining plate and at least one duct forming a cooling loop within the side lining plate for receiving and circulating coolant supplied from outside of the cathode case, wherein the plate is formed of a material that is resistant to a corrosive environment in the cell and is operable to permit active control of heat transfer through the cell lining; and an outer coolant circuit disposed outside of the cathode case and connected to said duct.

11. The electrolysis cell as claimed in claim 10, further comprising a plurality of the plates arranged in the side lining of the electrolysis cell, wherein the plates are connected together to form a continuous cooling loop.

12. The electrolysis cell as claimed in claim 11, further comprising carbon anodes and/or inert anodes.

13. The electrolysis cell as claimed in claim 11, further comprising electrodes arranged vertically and/or horizontally.

14. The electrolysis cell as claimed in claim 11, wherein each of the plates is made of ceramics based on carbon, carbides, nitrides, borides or oxides or mixtures of these materials.

15. The electrolysis cell as claimed in claim 11, wherein each of the plates is made of carbon, silicon nitride, aluminum nitride, silicon carbide, silicon oxynitride, silicon aluminum oxynitride, titanium diboride, zirconium diboride or mixtures of these materials.

16. The electrolysis cell as claimed in claim 11, wherein each of the plates elements is provided with sleeves and/or transitions for connection to the outer coolant circuit.

17. The electrolysis cell as claimed in claim 11, wherein each of the ducts are formed so as to have an outer circular cross-section and a star-shaped, spiked or sinusoidal inner surface.

18. The electrolysis cell as claimed in claim 11, wherein each of the plate elements is made by dry or wet pressing, slip casting and/or stamping, and the ducts are made by means of grooves in plates that are subsequently glued together before sintering.

* * * * *